United States Patent [19]

Lamb et al.

[11] 4,384,534

[45] May 24, 1983

[54] ASH REMOVAL SYSTEM AND HEATING MECHANISM FOR WOOD WASTE BURNERS

[75] Inventors: Frank H. Lamb, Vancouver; Eichi Kikegawa, Richmond, both of Canada

[73] Assignee: Enterprises International, Inc., Olympia, Wash.

[21] Appl. No.: 201,313

[22] Filed: Oct. 27, 1980

[51] Int. Cl.[3] ..... F23J 1/00

[52] U.S. Cl. ..... 110/165 R; 110/288; 110/247; 110/255

[58] Field of Search ..... 110/281, 282, 288, 247, 110/255, 259, 165 R

[56] References Cited

U.S. PATENT DOCUMENTS

| | | | |
|---|---|---|---|
| 2,232,556 | 2/1941 | Nichols | 110/247 |
| 2,345,497 | 3/1944 | Owen | 110/247 |
| 2,524,087 | 10/1950 | Serafini | 110/288 |
| 2,656,799 | 10/1953 | Hatton | 110/288 |
| 3,577,938 | 5/1971 | Muirhead | 110/165 R |
| 3,577,939 | 5/1971 | Muirhead | 110/165 R |
| 3,861,333 | 1/1975 | Krumm | 110/165 R |
| 4,109,590 | 8/1978 | Mansfield | 110/165R |
| 4,203,374 | 5/1980 | Frederick | 110/255 |
| 4,244,305 | 1/1981 | Kawano et al. | 110/255 |

*Primary Examiner*—Henry C. Yuen

*Attorney, Agent, or Firm*—Seed, Berry, Vernon & Baynham

[57] ABSTRACT

Wood waste fuel is piled on a perforated grate within a combustion chamber. The fuel is burned by underfire air passing through the grate up through the pile. Ash forms at the bottom of the pile and is removed about a complete 360 degree perimeter where it falls into an ash pit and is subsequently removed from the burner. Fuel is fed to the burner through an elongated continuously expanding tube by a reciprocating ram feeder.

10 Claims, 4 Drawing Figures

10
12
14
16
20
22
24
26
30
32
34
40
42
44
45
46
50
60
FP
P
a
b
c
2
3

ASH REMOVAL SYSTEM AND HEATING MECHANISM FOR WOOD WASTE BURNERS

BACKGROUND OF THE INVENTION

1. Field of the Invention

This invention pertains to solid fuel, such as coal, agricultural and wood wastes, burners and, more particularly, to improvements in the ash removal and fuel feeding in burners.

2. Description of the Prior Art

The spent consumed ash in wood waste fuel burners has generally been removed by dropping the ash through an opening at a limited number of areas in the combustion chamber. This requires that the ash be removed through a substantial length of travel as it is carried by the sweeper or rabble arms to the vicinity of the ash discharge opening. Since there is always a small amount of residual unburned fuel present with the ash, this lingering of the ash in the vicinity of the underfire air or burning area frequently causes this unburned fuel to reach above stoichiometric temperatures forming slag. The slag is then difficult to remove.

Removal of ash has been a problem in solid fuel burners also due to the fact that the ash could bridge over the discharge openings or its consistency would so vary that it would be difficult to remove by automatic means.

In addition to the difficulties of ash removal, it has long been a difficult problem to feed the unburned fuel to the combustion chamber pile. Since the consistency of wood waste fuel in particular is frequently of greatly varying moisture content, size and frequently carries with it a lot of grit and debris, it tends to pack in the feed delivery tube. This packing results in discharge from the inner end of the delivery tube in a highly compacted cylinder which then, rather than falling uniformly around all 360° of the top of the pile, tends to fall consistently to one side, causing an irregular height to the pile. This irregular shape or height of the pile causes difficulty in controlling combustion, particularly where underfire air is being blown up through the pile. If the pile is not reasonably uniform or symmetrical, the underfire air causes blow holes through the pile, adversely affecting the combustion process.

SUMMARY OF THE INVENTION

It is an object of this invention to provide an improved ash removal system for a solid fuel burner.

It is another object of this invention to provide an ash removal system for a solid fuel burner which provides 360 degree discharge of the fuel from the combustion area.

It is still another object of this invention to provide a solid fuel ash removal system which allows controlled heating of the ash to heat it to reach a desired consistency in size and texture.

Basically, these objects of the invention are obtained by discharging the ash from the floor of the combustion chamber through a full 360 degree discharge opening. The discharge opening is of a restricted vertical height so that only the lowermost portion of the pile, which contains predominantly ash, can be discharged as the ash is moved toward the discharge opening. In the preferred embodiment, the area adjacent the discharge opening on the floor of the combustion chamber is removed from the area of underfire air so that by controlling the residence time of the ash and residual unburned fuel mixed with the ash, substoichiometric burning can take place, resulting in a controlled consistency of the ash moved through the discharge opening.

It is another object of this invention to provide an improved feeding mechanism for feeding the fuel pile of a solid fuel burner.

Basically, this object is obtained by using an elongated feed tube having a uniformly increasing, expanding diameter from the exterior toward the center of the combustion chamber. The fuel is forced through the feed tube by a reciprocating ram, with the continuously expanding diameter reducing the friction on the fuel, thus reducing the undesirable compaction. In a modified form of the invention, primary underfire combustion air is also introduced at a pressure higher than that in the combustion chamber into the feed tube so that there is a slight positive pressure within the feed tube to block any combustion gases from leaking back to atmosphere through the feed tube.

DETAILED DESCRIPTION OF THE PREFERRED EMBODIMENTS

Figure 1:
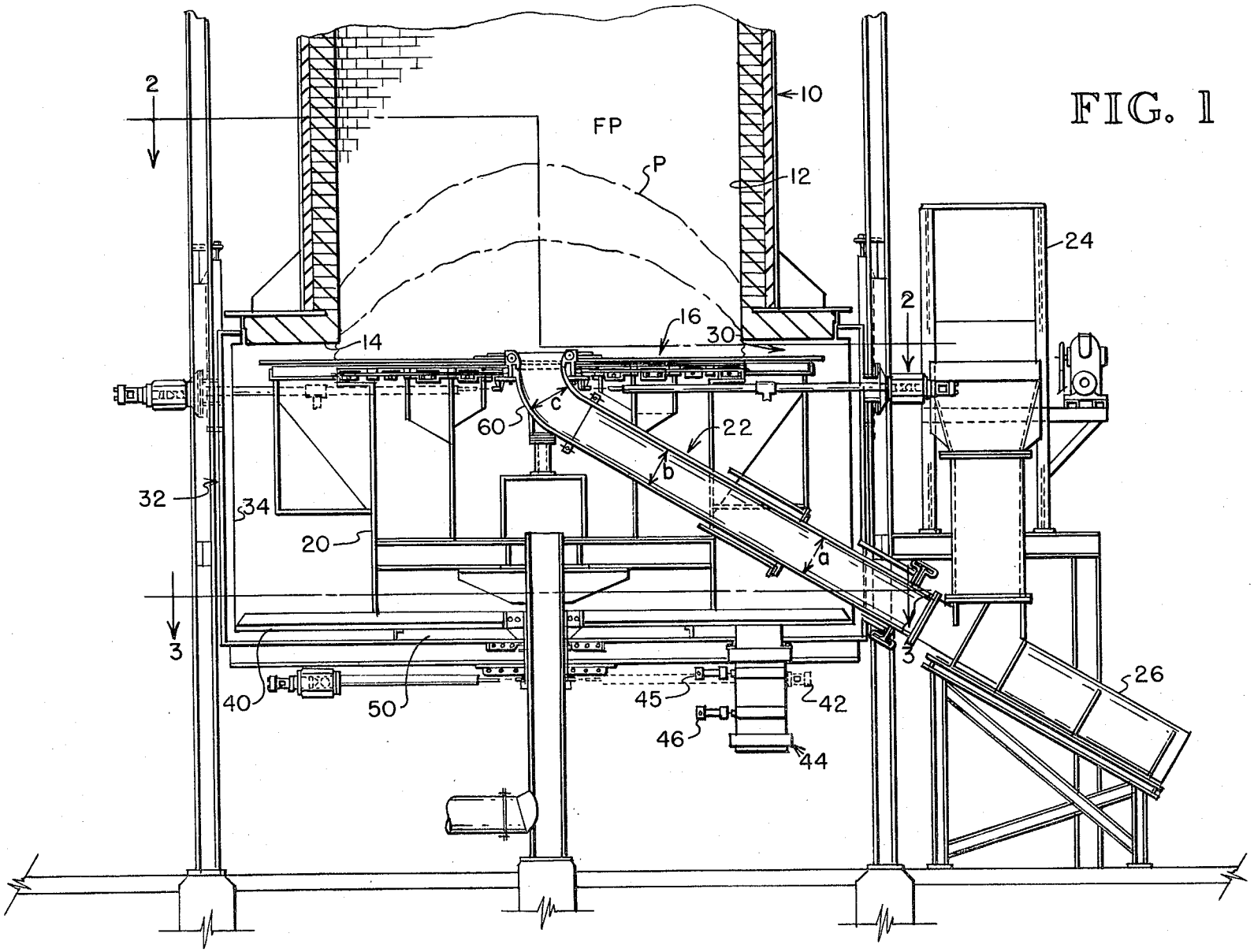
FIG. 1 is a fragmentary vertical section of a burner embodying the principles of the invention.
Figure 2:
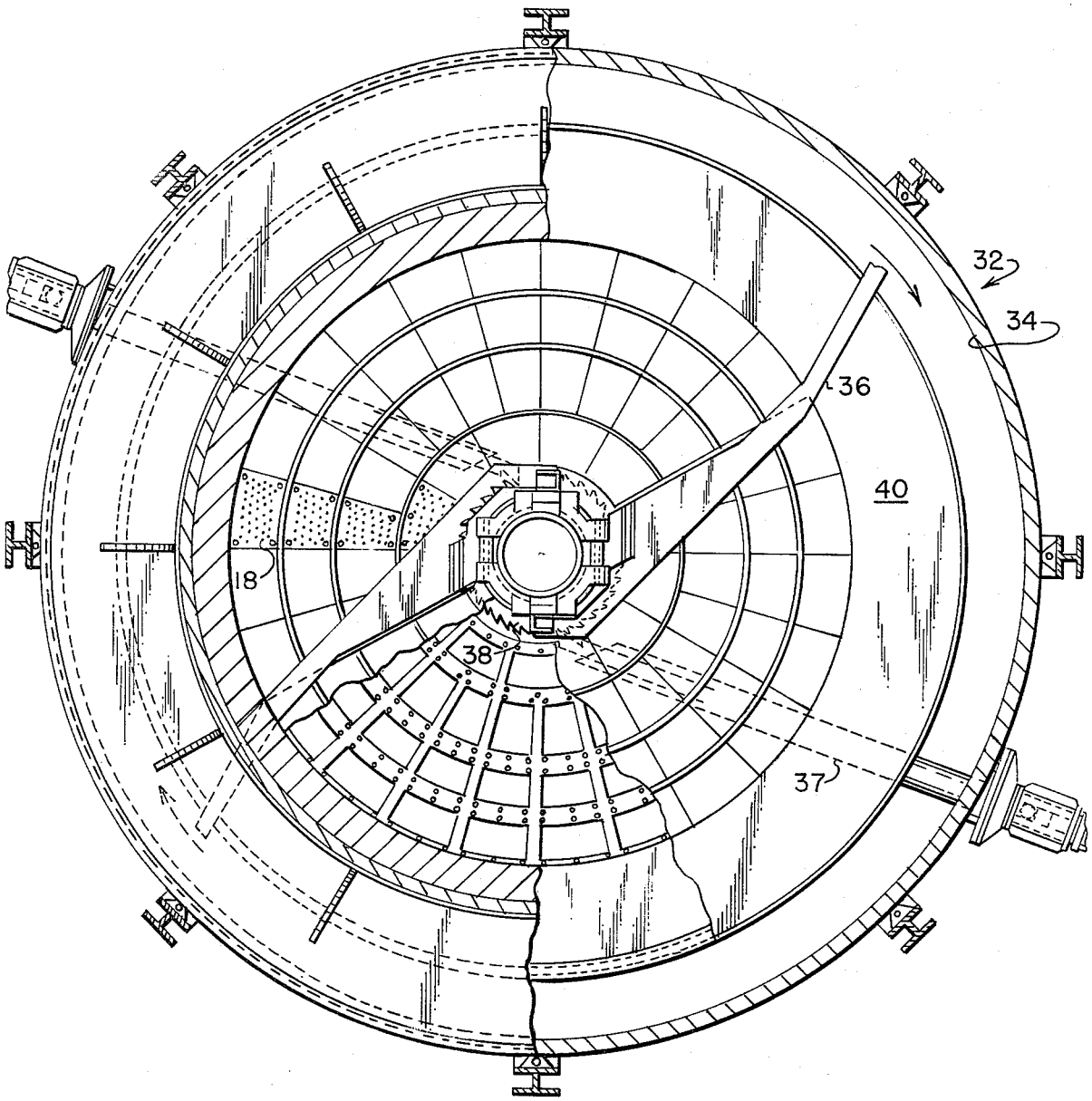
FIG. 2 is a section taken along the line 2—2 of FIG. 1 with parts broken away for clarity.
Figure 3:
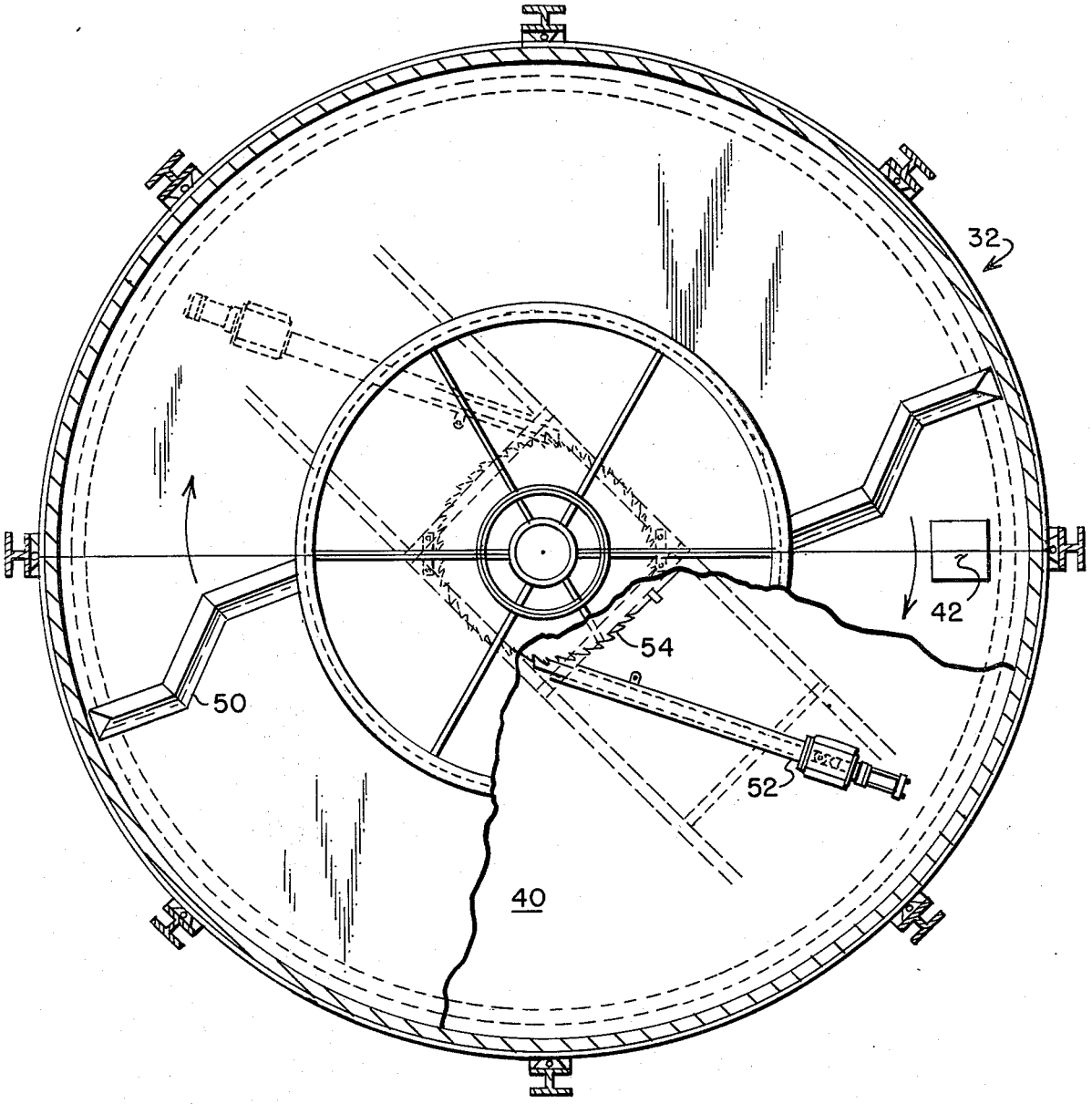
FIG. 3 is a section taken along the line 3—3 with parts broken away for clarity.

As best shown in FIG. 1, the burner includes a combustion chamber 10 having a refractory sidewall 12 terminating in a lower edge 14. The lower end of the combustion chamber has a floor 16, including a perforated grate 18 (FIG. 2) which communicates with a pressurized underfire air chamber 20.

A feed mechanism 22 delivers fuel from a hopper 24 through the use of a conventional reciprocating ram 26 and deposits this fuel at the top of a pile P generally along a central feed path, shown in phantom lines as FP. The pile takes the shape advantageously as shown in FIG. 1, and its height will vary during the combustion process, with the outer peripheral edge of the pile moving vertically up and down along the refractory wall 12. As is well known with this kind of wood waste fuel and pipe formation, ash will form due to the substoichiometric combustion of the fuel in the pile, with the fuel migrating downwardly to the bottom of the pile.

A circumferential discharge opening 30 is provided for the full 360 degrees of the combustion chamber. In the preferred embodiment, the discharge opening is formed between the edge 14 of the refractory wall and the floor 16, and is surrounded at its perimeter by an ash pit 32 having a sidewall 34.

Ash is pushed from the lower portion of the pile by a set of rabble arms 36 which are rotated at a controlled speed by a set of opposed hydraulic pistons and cylinders 37. The rod ends of the piston and cylinder units engage a ratchet wheel which is connected to the rabble arms so that by the simultaneous, synchronous reciprocation of the rod ends of the piston and cylinder assemblies, the ratchet wheel is rotated in a controlled manner. Preferably, the timing of the rotation is adjustable to vary the consistency of the ash being discharged, as will be described.

Radially outward from the grates 18, the floor of the combustion chamber 10 is provided with a peripheral dead plate 40. Combustion air from the underfire air chamber 20 passes up through the perforations in the grate 18 for burning the fuel in the pile, but air cannot pass through the solid dead plate 40. This restricts the amount of air which is in the presence of the pile that is on the dead plate. Most of the material on the dead plate will be ash since it is being swept radially outwardly from below by the rabble arms 36. The edge 14 of the combustion chamber keeps the unburned fuel from being pushed radially outward to the dead plate. As the fuel reaches the dead plate, any small amount of residual fuel still remaining in the ash can be burned at a slower rate and at a lower temperature since there is not sufficient underfire air to cause slagging. Thus, by controlling the speed or timing of the rotation of the rabble arms, the residual time of the ash on the dead plate away from the concentrations of underfire air can be controlled. As a result, the consistency of the ash being produced can be varied merely by changing the residual time of this ash on the dead plate. Ash from the consistency of large marbles down to the consistency of powder can be achieved in this manner. If the consistency of the ash can be controlled, it makes its subsequent removal and handling a much easier process.

The discharge pit 34 also has a bottom wall 40 having a single opening 42. Since the discharge pit, as well as the combustion chamber, are pressurized from combustion gases, a gate mechanism 44 is provided for removing the ash from the pit without leaking gases to the atmosphere. For this purpose, the gate mechanism is provided with an upper gate 45 and a lower gate 46 which can be moved by conventional pistons and cylinders to open and closed positions. By closing the bottom gate 46 and opening the top gate, the ash can be charged into the gating mechanism; and then by closing the upper gate, the lower gate can be removed so that mostly ash with very little combustion air leaking or gases will be discharged.

Ash which falls from the 360 degree perimeter of the floor 16 of the combustion chamber is moved to the discharge opening 42 by a second set of rabble arms which also are rotated by a pair of opposed cylinder piston mechanisms 52 which rotate a cogwheel 54 that is connected to the rabble arms 50. Since the ash pit is out of the intensely hot region of the combustion chamber, the chance of overheating or formation of slag is remote, so the removal of the ash at this location is far less critical than the removal which takes place in the combustion chamber.

Figure 4:
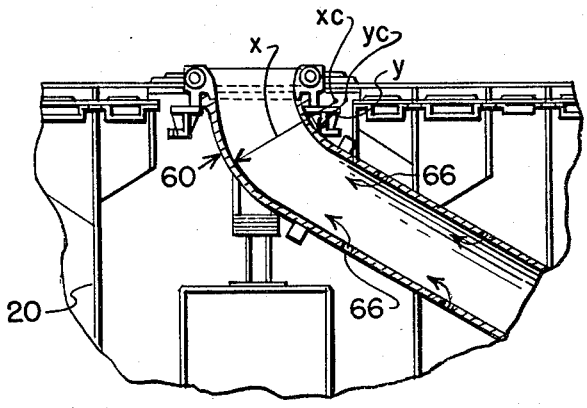
FIG. 4 is a fragmentary schematic of a portion of the feed tube employed in the embodiment of this invention.

The feed tube 22 is of a uniformly or constantly expanding diameter, with the diameter "a" being less than the diameter "b," which again is less than the diameter of a curved section 60 which joins the floor of the combustion chamber. As best shown in FIG. 4, the radius x of the lower curved wall of the curved section 60 of the feed tube is located from a center point xc, which is closer to the wall than the radius y of the upper sidewall of the curved section 60 with its center point yc. This condition maintains the uniform expansion of the tube, not only in the straight section but also through this final, curved section. The continuous expansion of the tube reduces the sidewall friction, thus forming a feed of fuel which is less compacted and falls more uniformly as it reaches the top of the pile through the feed path FP.

In a modified embodiment, as shown in FIG. 1, air holes 66 are placed in the feed tube, which is located within the pressurized air chamber 20. Since the pressure within chamber 20 is greater than the pressure within the combustion chamber 10, the air passing through the ports 66 creates a slight positive pressure which blocks leakage of combustion gases or smoke from the combustion chamber back out through the feed tube. In addition, the air entering the ports 66 helps to fluidize and reduce friction of the feed as it is passing through the feed tube, particularly at the important critical area of the curved section 60.

While the preferred embodiment of the invention has been illustrated and described, it should be understood that variations will be apparent to one skilled in the art. Accordingly, the invention is not to be limited to the specific embodiment illustrated in the drawing.

We claim:

1. A solid fuel burner of the type having a combustion chamber, a floor in said chamber having a grate for supporting a pile of fuel, means for feeding the pile, means for introducing underfire combustion air through said grate to said pile for burning the combustible matter in the fuel and leaving a residue ash, the improvement comprising:

an ash removal system for said burner, said system including a generally continuous peripheral ash discharge opening surrounding substantially the entire periphery of of said combustion chamber and located radially outward of of said combustion chamber and located radially outward of said grate, and means for moving ash from the bottom of said pile radially horizontally out through said peripheral ash discharge opening whereby ash is removed at substantially all locations around said pile, said ash removal system including means limiting the vertical height of said discharge opening and blocking radial movement of an upper unburned portion of the pile for limiting the ash discharged to the lowest and, consequently, most fully combusted portion of the pile, thus restricting removal of unburned fuel.

2. The burner of claim 1, said ash removal system including means limiting the vertical height of said discharge opening for limiting the ash discharged to the lowest and, consequently, most fully combusted portion of the pile, thus restricting removal of unburned fuel.

3. The burner of claim 1, said floor including a circumferential generally air impervious dead plate surrounding said area of the grate which passes the underfire air, said plate being located between the grate and the discharge opening, whereby ash leaving said grate has a residence period removed from underfire combustion air for lower temperature, slower combustion to further burn the fuel remaining in the ash without forming slag.

4. The burner of claim 1, including an ash pit below said combustion chamber, said pit having a bottom wall and a circumferential sidewall, said pit sidewall surrounding said ash discharge opening, whereby ash moved through the discharge opening falls into said pit, and means in said pit for removing the ash from the pit.

5. The burner of claim 4, said ash pit bottom wall including an opening for receiving ash, means for moving the ash to said bottom wall opening, and gate means for maintaining an air seal on said bottom wall opening as the ash is removed.

6. The burner of claim 1, said means for moving ash from the bottom of said pile including a set of opposed rabble arms and means for rotating said rabble arms for sweeping the ash from the bottom of the pile out said discharge opening.

7. The burner of claim 3, said means for moving said ash from the bottom of said pile including a set of opposed rabble arms and means for rotating said rabble arms at varying speeds for controlling the residence time of the ash on said dead plate, thereby controlling the amount of burning to which the ash is subjected.

8. The burner of claim 1, said means limiting the vertical height of the discharge opening, including the lower edge of the combustion chamber sidewall.

9. The burner of claim 1, said floor including a circumferential dead plate surrounding said area of the grate through which underfire air passes for passing the ash through the discharge opening only after passing the dead plate removed from underfire air, including an ash pit below and surrounding said discharge opening, said combustion chamber floor having a peripheral terminal edge within said pit whereby ash free-falls off said floor into said pit, and means for removing the ash from said pit.

10. The burner of claim 6, said means for rotating the rabble arms including a drive cog connected to said rabble arms and a set of opposed reciprocating actuators extendible to rotate said drive cog.

* * * * *

UNITED STATES PATENT AND TRADEMARK OFFICE

CERTIFICATE OF CORRECTION

PATENT NO. : 4,384,534

DATED : May 24, 1983

INVENTOR(S) : Frank H. Lamb; Eichi Kikegawa

It is certified that error appears in the above—identified patent and that said Letters Patent is hereby corrected as shown below:

At Column 4, line 30, of the patent, in claim 1, delete line 30; line 31 delete "chamber".

Signed and Sealed this

*Twenty-seventh* Day of *September 1983*

[SEAL]

*Attest:*

GERALD J. MOSSINGHOFF

*Attesting Officer*

*Commissioner of Patents and Trademarks*